United States Patent [19]

Weil

[11] 4,377,195

[45] Mar. 22, 1983

[54] PRIVATE CUBICLE ENCLOSURE

[76] Inventor: Hans Jack Weil, 550 Sheridan Sq., Evanston, Ill. 60202

[21] Appl. No.: 160,328

[22] Filed: Jun. 17, 1980

[51] Int. Cl.[3] ..... A47H 23/02

[52] U.S. Cl. ..... 160/237; 160/330; 160/DIG. 7; 66/195

[58] Field of Search ..... 160/237, 385, 386, 387, 160/DIG. 7, 330; 66/170, 192, 193, 195, 203; 5/163; 4/608, 610; D47/6 D, 6 E

[56] References Cited

U.S. PATENT DOCUMENTS

| | | | |
|---|---|---|---|
| 265,875 | 10/1882 | Sawyer et al. | 160/237 |
| 1,475,333 | 11/1923 | Ward | 66/195 |
| 2,017,830 | 10/1935 | Geller | 160/237 X |
| 2,083,991 | 6/1937 | Geller | 160/237 X |
| 2,093,269 | 9/1937 | Geller | 160/237 X |
| 2,123,413 | 7/1938 | Geller | 160/237 |
| 2,149,011 | 2/1939 | Fischel | 160/237 |
| 2,371,039 | 3/1945 | Fischel | 160/385 |
| 2,416,438 | 2/1947 | Fischel | 160/386 |

FOREIGN PATENT DOCUMENTS

| | | | |
|---|---|---|---|
| 39649 | 10/1931 | France | 160/DIG. 7 |
| 2031967 | 4/1980 | United Kingdom | 66/195 |

OTHER PUBLICATIONS

Wheatley, B., *Raschel Lace Production,* N.Y., National Knitted Outerwear Association, 1972, pp. 59–76.

Reisfeld, A., *Warp Knit Engineering,* N.Y., National Knitted Outerwear Association, 1966, pp. 379–394.

Johnson, T., *Tricot Fabric Design,* N.Y., McGraw-Hill Book Co., Inc., 1946, pp. 55, 60, 61, 62.

Paling, D., *Warp Knitting Technology,* London, Columbine Press, 1968, pp. 120, 121, 123, 128, 176, 179, 341, 343.

*Cubicle Track and Curtains,* Form HRA-113/1078, Hill-Rom Co., Inc., Batesville, Indiana, 8 pages, 1975.

*Cubicle Curtains for Hospitals and Nursing Homes,* 312/427-4102, Clearco-Reibman, Chicago, Illinois, 18 pages, 1979.

*Imperial Flameproofed Cubicle Curtains,* Imperial Fastener Co., Inc., Pompano Beach, Florida, 23 pages 1979.

*Fire Retardant Draperies,* Commercial Drapery Contractors, Silver Spring, Maryland, 60 pages, 4/78–4/79.

*Primary Examiner*—Robert Mackey

*Attorney, Agent, or Firm*—Dressler, Goldsmith, Shore, Sutker & Milnamow, Ltd.

[57] ABSTRACT

An integral ventilating curtain is disclosed for use with a supporting structure to define a cubicle enclosure preferably of the type utilized for hospital beds or the like. The ventilating curtain is in the form of a fabric constructed of knitted inherently flame retardant yarn materials, and having a first section having a stitch density sufficient to render it sufficiently opaque to provide privacy for the user thereof. A second section is formed integrally with the first section and is in the form of an open mesh construction having knitted stitches of lesser density than the density of the knitted stitches of the first section so as to permit the passage of light and air to provide light and ventilation for the user.

15 Claims, 4 Drawing Figures

PRIVATE CUBICLE ENCLOSURE

TECHNICAL FIELD

This invention relates to a ventilating curtain and more particularly to a hospital cubicle ventilating curtain which may be suspended from a supporting structure to provide a private cubicle enclosure for one or more patients.

BACKGROUND ART

It is well known that in order to make it possible for hospitals to serve a multiplicity of patients, the hospital rooms are often equipped with more than one bed so that each hospital room may be used by more than one patient. In certain instances, hospital rooms are provided with two, three or more beds while patients often assigned to such rooms are sufficiently ill to require the privacy of a single-bedroom; however, because of the fact that it is often impossible for a hospital to provide the number of single-bedrooms required by such patients, the practice of utilizing an individual cubicle around each bed has been adopted to at least ensure privacy to such patients at least part of the time in which they are hospitalized. The curtain is usually constructed of a lower portion which is sufficiently opaque to provide privacy to the patient and an upper portion having a porous character such as a wide mesh construction which provides transmission of light and ventilating air therethrough for the patient. In order to provide such an arrangement, however, the prior art attempts have resorted to elaborate and cumbersome techniques which are not only somewhat less than totally effective, but which are extremely expensive to produce.

U.S. Pat. No. 2,125,422 to Bosworth relates to a fabric for curtains or the like of woven construction which is intended to make unnecessary the need for doubling over the edges to provide marginal hems. U.S. Pat. No. 2,037,629 to Holgate relates to ornamental fabric curtains having a loosely woven net-like portion or panel adjacent to one side edge, and relatively close woven portions or panels on opposite sides of the loosely woven panel, one side panel being a relatively narrow edge band, so that the stitching of panels and concealment of the stitched edges is eliminated. U.S. Pat. No. 3,321,003 to Boerner relates to a hanging drapery assembly for use in hospital rooms and having upper and lower sections attached to each other. U.S. Pat. No. 3,438,422 to Tames relates to a ventilating curtain for hospital rooms which utilizes an elaborate and expensive construction to provide an upper ventilating portion, the ventilating openings of which are not subject to clogging by air-borne cotton lint normally present in the atmosphere of hospital rooms.

Most hospital cubicle curtains presently available are constructed of several sections of different woven materials stitched together, with the top section being of mesh—or open—construction. The curtains are expensive to manufacture, and the several sections thereof are usually of materials having differing dyeing and wear characteristics which is particularly disadvantageous and noticeable after several washings. I have invented an improved integral knitted ventilating curtain which may be suspended from a supporting structure to define at least one cubicle enclosure and which avoids the disadvantages of prior art curtains. My ventilating curtain is constructed according to the method of my invention, which method involves a relatively inexpensive procedure, and which may provide a plurality of curtains of unlimited length and of uniform color and appearance, while avoiding the disadvantages of prior art curtains.

DISCLOSURE OF INVENTION

The invention relates to an integral ventilating curtain for use with a supporting structure to define at least one cubicle enclosure, which comprises a fabric constructed of knitted, inherently flame resistant yarn materials, the fabric having a first section having a stitch density sufficient to render said first section sufficiently opaque to provide privacy for a user on one side thereof, a second section formed integrally with the first section, the second section being in the form of an open mesh construction having knitted stitches of lesser density than the density of the knitted stitches of the first section to permit the passage of light and air therethrough to provide ventilation for the user.

In the preferred form, the invention pertains to an integral ventilating curtain of seamless construction for use with a supporting structure to define at least one private cubicle enclosure. The curtain comprises a fabric constructed of warp knitted, inherently flame resistant yarn materials and the fabric has a first warp knitted section having a stitch density sufficient to render the first section sufficiently opaque to provide privacy for a user on one side thereof, and a second section formed integrally with the first section. The second section is warp knitted and of a mesh construction which has knitted stitches of lesser density than the knitted stitches of the first section to permit the passage of light and ventilating air therethrough. The curtain has a third section formed integrally with the second section, the third section being of warp knitted construction having a stitch density greater than the stitch density of the warp knitted stitches of the second section and being of sufficient strength to support said fabric in suspended relation with a supporting structure.

The flame resistant yarn materials are also spark resistant and are heat-sensitive—or thermoplastic—such that the knitted fabric may be stretched and subjected to heat at a prescribed temperature to cause the fabric to retain its stretched configuration and to become dimensionally stable. In the preferred embodiment, the fabric is constructed of polyester yarns which are heat settable at temperatures within the range of 350°-400° F., and which may or may not be textured.

The marginal edge portions of the preliminary knitted fabric are hemmed to provide finished marginal hems, and the third section is provided with a number of grommets—or eyelets—which facilitate hanging the curtain from a supporting structure, such as a track which may be attached to the ceiling of a hospital room directly over the bed.

The invention also relates to a method of making the inventive integral ventilating curtain. The method comprises directing a plurality of inherently flame resistant heat-settable yarns to the knitting elements of a warp knitting machine, warp knitting a fabric of integral construction having a first major section having a stitch density sufficient to prevent transmission of visual images, a second section formed integrally with the first section and of openwork construction such that upon stretching the fabric, the second section has a stitch density less than the stitch density of the first section to facilitate the transmission of light and ventilating air therethrough, and a third minor section having a stitch density approximately equal to the stitch density of the first section. The method further comprises dyeing the fabric, stretching the fabric, subjecting the fabric to heat while maintaining it in a stretched condition so as to heat-set the fabric to provide dimensional stability, and providing means in the third section to facilitate suspending the fabric from a supporting structure to define a cubicle enclosure.

According to the method of the invention, the marginal edge portions of the knitted fabric are folded over upon themselves and stitched in position to provide furnished marginal hems. After the third section of the fabric is hemmed, a plurality of grommets are inserted to facilitate hanging the curtain from a supporting structure.

By constructing the fabric of heat-settable yarn materials on a warp knitting machine, it is possible to construct the second section in the form of an openwork such that stretching the fabric on a tenter frame causes the second section to assume a porous and open mesh configuration. Thus, upon subjecting the fabric to the proper heat-setting temperatures while maintaining the stretched condition, the fabric will assume that stretched condition on a permanent basis. For polyester yarns, it has been determined that the fabric must be subjected to temperatures within the range of approximately 350°–400° F.

Thus it will be appreciated that by warp knitting such heat-settable yarns, it is possible to construct an integral fabric which—after stretching and heating—will assume the desired shape needed for a cubicle curtain. In addition, the integral character of the fabric facilitates uniform dyeing of the fabric and permits the fabric to wear uniformly through constant use and periodic washings. This is in contrast to the prior art curtains which were constructed of several materials whereby the materials had different wear and wash resistance, thus resulting in nonuniform appearance after limited use.

BEST MODE FOR CARRYING OUT THE INVENTION

In the description which follows, reference to a warp knitting machine contemplates knitting machines known as "Warp Knitting", "Flat-bed" or "Raschel" knitting machines on which knitted fabrics are produced having warp threads which follow zig-zag paths forming a loop at each change of direction. The loops are intermeshed during the knitting action with other loops formed by adjacent warp threads which follow a similar path. Each vertical column of loops is known in the art as a "Wale", and each horizontal row of loops is known as a "Course" and the texture, or density of the fabric is expressed in terms of courses and wales per inch. In the construction of the present inventive curtain, however, the reference to "stitch density" contemplates the number of stitches per given unit area of the finished curtain and conveniently distinguishes generally, the opaque section of the finished curtain as opposed to the mesh section.

Figure 1:
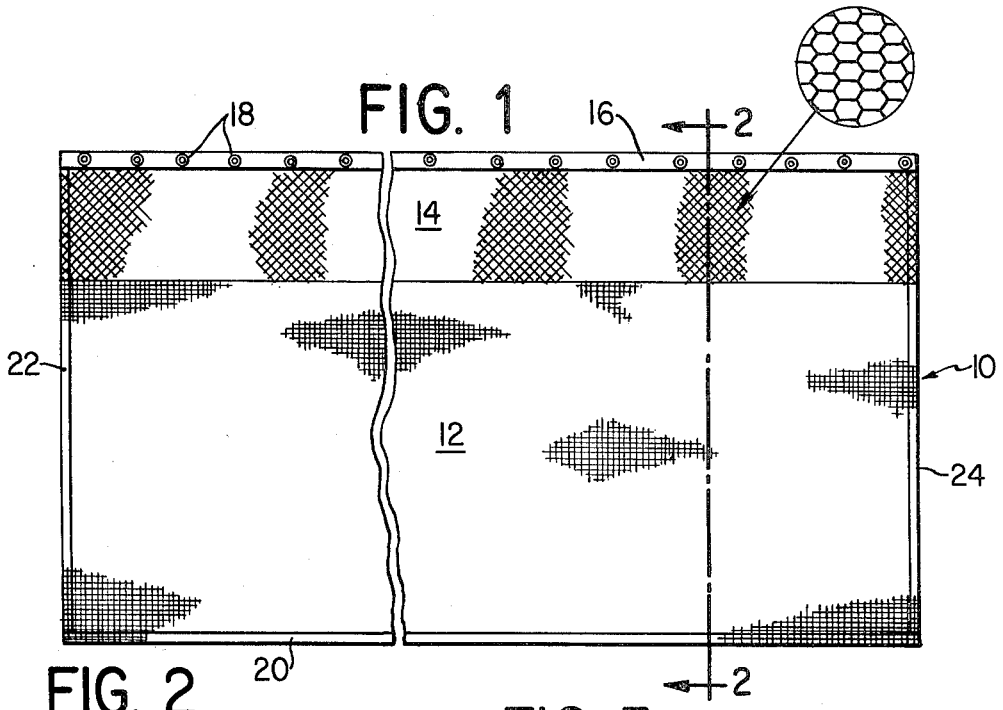
FIG. 1 is a plan view of an integral ventilating curtain constructed according to my invention.

Referring to FIG. 1, there is illustrated an integral ventilating curtain 10 of warp knit construction. The curtain 10 is preferably constructed on a warp knitting machine which utilizes a plurality of guide bars and latch knitting needles to produce a warp knit fabric. Generally, the knitting needle motion is substantially up and down, and the guide bar motion is in generally lateral directions usually referred to as "SHOG" movements.

The integral ventilating curtain 10 illustrated in FIG. 1 is preferably constructed entirely of yarn materials which are inherently flame and spark resistant such as TREVIRA® polyester yarns marketed as Types 271 and 692 by Hoechst Fibers Industries, Spartanburg, S.C.The use of inherently flame and spark resistant yarn materials renders my integral ventilating curtain particularly adaptable for use in applications requiring fireproof equipment and for this reason, my integral curtain is particularly contemplated for use in defining individual hospital bed cubicle enclosures for bed-ridden patients.

Figure 2:
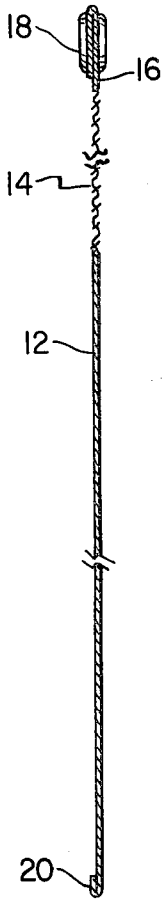
FIG. 2 is a view taken along lines 2—2 of FIG. 1.

Referring once again to FIG. 1, the integral ventilating curtain 10 includes a first section 12 constructed of warp knit chain stitches of sufficient density to render the section sufficiently opaque to provide privacy for an individual such as a hospital patient who will be positioned on one side of the curtain. The curtain also includes a second section 14 which is constructed integrally with the first section and which is of a chain stitch density less than the chain stitch density of the first section 12 so as to provide a plurality of relatively wide spaces defined by a warp knit mesh construction thereby rendering the section 14 sufficiently porous to facilitate the transmission of light and ventilating air for one or more individual users who may be positioned on one side of the curtain. The curtain 10 further includes a third section 16 which is constructed integrally with the second section 14 and which preferably has the same stitch density as the first section 12. As can be seen more clearly in FIG. 2, the third section 16 is formed by doubling the densely knit marginal portion upon itself one or more times and stitching (stitches not shown) the doubled portions together so as to provide reinforcement for the third section to strengthen it sufficiently to support the entire weight of the curtain when suspended from a supporting structure (not shown). To facilitate the suspended support of the curtain from the supporting structure, a plurality of grommets (or eyelets) 18 are positioned in spaced relation along the length of the curtain and extend through the total thickness of the fabric portions. These grommets also provide additional reinforcement for the third section 16.

Referring once again to FIG. 1, the lower marginal portion of the first section 12—which is positioned opposite the third section 16—is folded upon itself one or more times and the portions are stitched together to form a finished hem 20. In addition, the same procedure is followed with the side marginal portions as shown to form hems 22 and 24, respectively. As will be seen in the description which follows, the production of my inventive curtain on a warp knitting machine of the type illustrated in FIG. 3 makes it particularly convenient for producing curtains of any desired lengths which may be required since the length of the curtain is unlimited by the fact that it may be continuously produced as desired in a direction parallel to the wales on the warp knitting machine as shown by arrow A in FIG. 3. The warp knitting machine however, is of sufficient width across the wales to produce a finished warp knit curtain of a height (which corresponds to the width of the machine and which, for convenience, will hereinafter be referred to as the "width") at least equal to, or greater than the height required of most cubicle curtains, particularly hospital cubicle curtains. For example, the curtain 10 of FIG. 1 may be produced on a RACOP TP brand warp knitting machine marketed by LIBA MACHINENFABRIK GMBH, Hamburg, Germany, on which it is possible to produce a warp knit fabric from which the cubicle curtain shown in FIG. 1 may be constructed having a width (off the machine) of approximately 84 inches and an unlimited length, which length is of seamless construction as shown. In addition, it should be noted that if desired, warp knitting machines are available to produce the basic fabric in double widths whereby the knitted product (off the machine) may be of a width of up to 168 inches.

Figure 3:
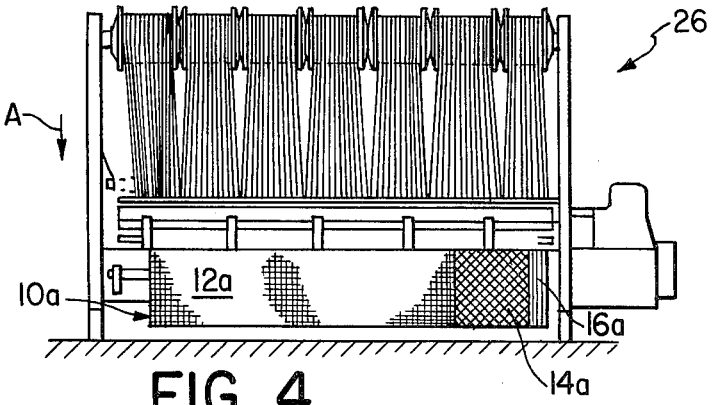
FIG. 3 is a front elevational view of a warp knitting machine of the type used to produce the method of my invention for constructing the integral ventilating curtain of FIG. 1.
Figure 4:
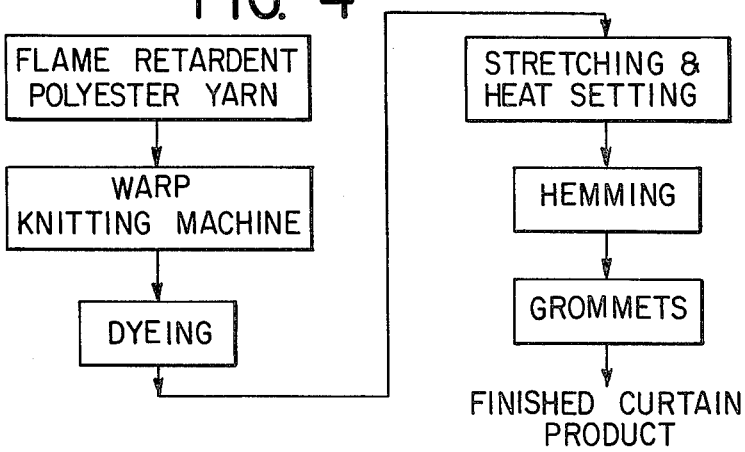
FIG. 4 is a schematic diagram illustrating the separate steps utilized for constructing the integral ventilating curtain of FIG. 1 using a warp knitting machine of the type shown in FIG. 3.

Referring now to FIG. 4, there is shown a schematic diagram of the procedural steps which are utilized to produce the integral ventilating curtain shown in FIG. 1. As shown in the schematic diagram, inherently flame retardant polyester yarn materials such as TREVIRA ® polyester yarns Types 271 and 692 as previously described, are directed to warp knitting machine 26 shown in FIG. 3. The warp knitting machine shown in FIG. 3 produces a basic integral knit fabric 10*a* as shown, having a first section 12*a* of relatively dense warp knit stitches, a second section 14*a* of mesh construction, and a third section 16*a* (selvedge) of lesser width than either of the first and second sections and preferably having a warp knit stitch density equal to the stitch density of the first section 12*a*. As stated previously, the length of the fabric 10*a* is unlimited and may be produced of integral seamless construction by merely continuing to feed unlimited flame retardant polyester yarn ends to the warp knitting machine on a continuous basis. After production of the basic warp knit fabric 10*a* is completed, the fabric is first dyed and then subjected to stretching on a tenter frame whereby it is heat-set as illustrated schematically in FIG. 4. During the stretching step, the mesh section 14 will stretch sufficiently to separate the portions which are openly knitted such that the final height of the basic fabric 10*a* will be approximately 104 inches and the mesh portion will have an openwork—or mesh—appearance.

After the dyeing and heat setting, the marginal edge portions are folded upon themselves one or more times on all four sides as previously described. Thereafter section 16*a* is further strengthened by insertion of grommets 18 as shown to complete the finished curtain product 10 as shown in FIG. 1. For TREVIRA ® brand polyester yarns, the heat setting temperature will be within the range of approximately 350° F. to 400° F. Since temperatures greater than 400° F. may result in stiffening of the fabric, this temperature range should not be exceeded. However, other suitable yarn materials may be used which may be heat-set at temperatures other than the temperatures recommended for polyester yarns.

A particular feature of the present invention pertains to the use of heat sensitive, or thermoplastic yarn ends on a warp knitting machine, which yarns may be heat-set to retain their shape or to render them dimensionally stable. Thus, it will be appreciated that when the basic fabric 10*a* is removed from the warp knitting machine, it will appear to be substantially opaque across the entire width because the mesh section 14*a* will be in the unstretched condition. For convenience and for purposes of clarity with respect to this description, the mesh section 14*a* as actually illustrated in FIG. 3 is shown schematically as a mesh section; however, in fact, the mesh section does not appear as a mesh openwork until it is mechanically stretched on a tenterframe and heat-set so as to retain its new stretched configuration. Thus, when the fabric 10*a* is stretched, the mesh section will actually assume the openwork effect wherein the number of stitches per unit area is less than the number of stitches for the same unit area in the opaque section 12*a*. The preferred openwork is in the form of a plurality of interconnected hexagonal shapes as illustrated, for example, in the inset to FIG. 1.

As can be seen, the unique integral construction of the ventilating curtain as described above in connection with FIGS. 1–4 facilitates the production of a fabric of seamless and uniform construction—and hence a pleasant appearance—while being constructed entirely of the same flame retardant yarn materials. Thus, this fabric is heat set and dyed according to a uniform procedure resulting in a high quality cubicle curtain of uniform color. The particular technique by which the curtain is constructed requires minimum amounts of labor to convert the basic fabric 10*a* shown in FIG. 3 into the final cubicle curtain 10 shown in FIG. 1 thereby resulting in an improved curtain product at a minimum cost. A significant additional advantage of the present curtain construction resides in the fact that the basic knitted fabric 10*a* may be constructed on a warp knitting machine in an extremely rapid fashion. This productional aspect further minimizes the cost of production of the finished curtain, making the finished curtain an extremely desirable product for use in defining hospital cubicle enclosures for bedridden patients. Moreover, it will be appreciated that the unlimited length and relatively extensive height which is available through the use of the warp knitting machine makes it possible to produce a curtain which may be utilized to define private cubicles wherever such cubicles may be desired, whether in a private home or in a private hospital room to define a cubicle for a single-patient or even in a hospital ward to define a cubicle large enough for more than one patient.

A preferred construction of the basic fabric from which the curtain of the present invention is produced and described hereinbelow with reference to a RACOP TP warp knitting machine having guide bars 1, 2, 3 and 4 and in which the stitches are described in terms of the respective guide bar positions and movements which are instrumental in directing the yarns in the appropriate directions around knitting needles (usually latch-type) which are moving upwardly and downwardly, so as to create the necessary stitches.

| | | Threading Information | | |
|---|---|---|---|---|
| Bar | Stitch | Solid Portion | Mesh Portion | Total No. Ends |
| 1 | 1001 | Full | Full | 2016 |
| 2 | 2310 | Full | None | 1764 |

-continued

| Bar | Stitch | Threading Information Solid Portion | Mesh Portion | Total No. Ends |
|---|---|---|---|---|
| 3 | 1012, 1012, 1012, 2321 2321, 2321 | None | Half | 126 |
| 4 | 2321, 2321, 2321, 1012 1012, 1012 | None | Half | 126 |

The reference to "full" herein contemplates one yarn end in each guide and the reference to "half" contemplates one yarn end in every other guide. The stitches indicate the sequence and positions of the guide bars. In the construction described above, the total width of the fabric off the machine will be approximately 84" prior to the stretching and heat-setting steps, after which the width of the fabric is stretched to 104". The pre-stretched dimensional relations are as follows:

1. Width of opaque section: 70.5"
2. Width of mesh section: 10.5"
3. Width of selvedge: 3.0"

The following numbers of ends are used:

Bar 1—84 inches×24 ends/inch=2016 (Total ends)

Bar 2—(84-10.5) inches×24 ends/inch=1764 ends (Opaque section)

Bar 3—10.5 inches×12 ends/inch=126 ends (Mesh section)

Bar 4—10.5 inches×12 ends/inch=126 ends (Mesh section)

After stretching, the total width of the fabric is approximately 104" as noted previously. Assuming the use of doubled one inch hems at the top and bottom of the finished curtain, the final height of the finished curtain may be approximately 96". Optionally, the curtain may be cut to any height desired to adapt it to any room size as needed.

I claim:

1. A private cubicle enclosure for use with a supporting structure, which enclosure comprises a fabric constructed of knitted, inherently flame resistant yarn materials, the fabric having a first warp knitted section having knitted stitches of a stitch density sufficient to render said first section sufficiently opaque to provide privacy for a user on one side thereof, the knitted stitches of said first section being of uniform stitch density throughout said first section, a second section directly contiguous with said first section and formed integrally with said first section, said second section being warp knitted and in the form of an open mesh construction having knitted stitches of lesser stitch density than the density of the knitted stitches of said first section to permit the passage of light and air therethrough to provide ventilation for the user, the knitted stitches of said second section being of uniform stitch density throughout said second section, said first and second sections being constructed entirely from the same yarn materials to impart to said fabric uniform dyeing, wearing and washing characteristics, and means associated with said fabric for suspending the entire fabric construction from a supporting structure.

2. The private cubicle enclosure according to claim 1 wherein said inherently flame resistant materials are thermoplastic yarn materials, said fabric being stretched and heat-set following knitting to provide said second section with said open mesh construction.

3. The private cubicle enclosure according to claim 1 wherein the openings in said second section are generally hexagonally shaped.

4. A private cubicle enclosure according to claim 1 wherein the marginal edge of said second section is provided with reinforcing means, said suspending means being associated with said reinforcing means.

5. The private cubicle enclosure according to claim 4 wherein the marginal edge of said second section is folded over to provide said reinforcing means.

6. A private cubicle enclosure for use with a supporting structure, which enclosure comprises a fabric constructed of warp knitted, inherently flame resistant yarn materials, the fabric having a first warp knitted section having knitted stitches of a stitch density sufficient to render said first section sufficiently opaque to provide privacy for a user on one side thereof, the knitted stitches of said first section being of uniform stitch density throughout said first section, a second section directly contiguous with said first section and formed integrally with said first section, said second section being warp knitted and in the form of an open mesh construction having knitted stitches of lesser stitch density than the knitted stitches of said first section to permit the passage of light and ventilating air therethrough to provide ventilation for the user, the knitted stitches of said second section being of uniform stitch density throughout said second section, a third section directly contiguous with said second section and formed integrally with said second section, said third section being of warp knitted construction having knitted stitches of a stitch density greater than the stitch density of the warp knitted stitches of said second section and being of sufficient strength to support said fabric in suspended relation with a supporting structure, said first, second and third sections being constructed entirely from the same yarn materials to impart to said fabric uniform dyeing, wearing and washing characteristics, and means associated with the third section for suspending the entire fabric construction from a supporting structure.

7. The private cubicle enclosure according to claim 6 wherein said warp knitted fabric is dimensioned, configured and constructed to define at least one private cubicle enclosure for a bedridden patient.

8. The private cubicle enclosure according to claim 7 wherein said third section is folded upon itself to provide a reinforced marginal section capable of supporting the entire fabric structure from a supporting structure.

9. The private cubicle enclosure according to claim 6 wherein said means associated with said third section for suspending said entire fabric construction from a supporting structure comprises a plurality of grommets positioned in spaced relation along said third section.

10. The private cubicle enclosure according to claim 9 wherein the marginal edge portion opposite said third section is folded upon itself to provide a finished hemmed marginal portion.

11. The private cubicle enclosure according to claim 10 wherein the remaining marginal portions extending along opposed sides thereof are folded upon themselves to provide finished marginal hemmed portions.

12. The private cubicle enclosure according to claim 11 wherein said fabric is constructed of at least one inherently flame resistant polyester yarn material.

13. The private cubicle enclosure according to claim 12 wherein said at least one polyester yarn material is a textured heat-set yarn material.

14. The private cubicle enclosure according to claim 13 wherein said at least one textured polyester heat-set yarn material is 150 denier.

15. The private cubicle enclosure according to claim 14 wherein said fabric is constructed entirely of inherently flame resistant heat-set polyester yarns.

* * * * *